US011794064B2

(12) United States Patent
Lagree et al.

(10) Patent No.: US 11,794,064 B2
(45) **Date of Patent: *Oct. 24, 2023**

(54) EXERCISE MACHINE REVERSIBLE RESISTANCE SYSTEM

(71) Applicant: Lagree Technologies, Inc., Chatsworth, CA (US)

(72) Inventors: Sebastien Anthony Louis Lagree, Chatsworth, CA (US); Matthew O'Brien, Gardena, CA (US); William Balzer, Gardena, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/715,504

(22) Filed: Apr. 7, 2022

(65) Prior Publication Data

US 2022/0226690 A1 Jul. 21, 2022

Related U.S. Application Data

(63) Continuation of application No. 17/139,209, filed on Dec. 31, 2020, now Pat. No. 11,298,582, which is a (Continued)

(51) Int. Cl.
*A63B 21/00* (2006.01)
*A63B 21/02* (2006.01)

(Continued)

(52) U.S. Cl.
CPC ..... *A63B 21/4045* (2015.10); *A63B 21/023* (2013.01); *A63B 21/0428* (2013.01);

(Continued)

(58) Field of Classification Search
CPC ..... A63B 22/02; A63B 22/20–208; A63B 22/0087; A63B 22/0089
See application file for complete search history.

(56) References Cited

U.S. PATENT DOCUMENTS 131,886 A 10/1872 Little
339,638 A 4/1886 Goldie (Continued)

FOREIGN PATENT DOCUMENTS

JP 106278 A 1/1998
KR 20040097734 A * 11/2004

(Continued)

OTHER PUBLICATIONS http://www.cognionics.com/index.php/products/hd-eeg-systems/quick-20-dry-headset; Cognionics Quick-20 Dry EEG Headset; Jun. 14, 2016.

(Continued)

*Primary Examiner* — Nyca T Nguyen
(74) *Attorney, Agent, or Firm* — Neustel Law Offices

(57) ABSTRACT

An exercise machine reversible resistance system for reversing the directional force of resistance against an exercise implement before, during, or after the performance of a routine of one or more exercises. The exercise machine reversible resistance system generally includes a frame, an elongated member movably positioned upon the frame, wherein the elongated member has a first run and a second run, a resistance device that applies a resistance force to the elongated member in a single direction, an exercise implement movably connected to the frame and a clutch connected to the exercise implement. The clutch is adapted to selectively engage the first run or the second run of the elongated member for selective control of the resistance direction of the exercise implement.

18 Claims, 6 Drawing Sheets

Related U.S. Application Data continuation of application No. 16/686,343, filed on Nov. 18, 2019, now Pat. No. 10,881,896, which is a continuation of application No. 15/871,950, filed on Jan. 15, 2018, now Pat. No. 10,478,663, which is a continuation of application No. 14/840,910, filed on Aug. 31, 2015, now Pat. No. 9,868,019.

(60) Provisional application No. 62/043,503, filed on Aug. 29, 2014.

(51) Int. Cl.

| | |
|---|---|
| ***A63B 22/00*** | (2006.01) |
| ***A63B 21/04*** | (2006.01) |
| ***A63B 22/20*** | (2006.01) |
| *A63B 21/005* | (2006.01) |
| *A63B 22/06* | (2006.01) |

(52) U.S. Cl.

CPC ..... *A63B 21/154* (2013.01); *A63B 21/157* (2013.01); *A63B 21/4035* (2015.10); *A63B 22/0087* (2013.01); *A63B 21/0058* (2013.01); *A63B 21/159* (2013.01); *A63B 22/0007* (2013.01); *A63B 22/0076* (2013.01); *A63B 22/0664* (2013.01); *A63B 22/20* (2013.01); *A63B 22/201* (2013.01); *A63B 22/203* (2013.01); *A63B 2208/0204* (2013.01); *A63B 2208/0219* (2013.01)

(56) References Cited

U.S. PATENT DOCUMENTS

| | | | | |
|---|---|---|---|---|
| 1,621,477 | A | 8/1925 | Pilates | |
| 3,582,069 | A | 6/1971 | Flick | |
| 3,770,267 | A | 11/1973 | McCarthy | |
| 3,806,094 | A | 4/1974 | Harken | |
| 4,013,068 | A | 3/1977 | Settle | |
| 4,679,786 | A * | 7/1987 | Rodgers | A63B 21/154 482/54 |
| 4,759,540 | A | 7/1988 | Yu | |
| 4,798,378 | A | 1/1989 | Jones | |
| 5,066,005 | A | 11/1991 | Luecke | |
| 5,201,694 | A | 4/1993 | Zappel | |
| 5,263,913 | A | 11/1993 | Boren | |
| 5,295,935 | A | 3/1994 | Wang | |
| 5,316,535 | A | 5/1994 | Bradbury | |
| 5,365,934 | A | 11/1994 | Leon | |
| D362,700 | S | 9/1995 | Breibart | |
| 5,503,609 | A | 4/1996 | Bull | |
| D382,319 | S | 8/1997 | Gerschefske | |
| 5,681,249 | A | 10/1997 | Endelman | |
| 5,738,104 | A | 4/1998 | Lo | |
| 5,812,978 | A | 9/1998 | Nolan | |
| 5,885,197 | A | 3/1999 | Barton | |
| 5,967,955 | A | 10/1999 | Westfall | |
| 5,989,163 | A | 11/1999 | Rodgers, Jr. | |
| 6,045,491 | A | 4/2000 | McNergney | |
| 6,152,856 | A | 11/2000 | Studer | |
| 6,179,753 | B1 | 1/2001 | Barker | |
| 6,261,205 | B1 | 7/2001 | Elefson | |
| 6,626,802 | B1 | 9/2003 | Rodgers, Jr. | |
| 6,790,162 | B1 | 9/2004 | Ellis | |
| 6,790,163 | B1 | 9/2004 | Van De Laarschot | |
| 6,926,646 | B1 | 8/2005 | Nguyen | |
| 6,929,589 | B1 | 8/2005 | Bruggemann | |
| 7,108,635 | B2 | 9/2006 | Howlett-Campanella | |
| 7,163,500 | B2 | 1/2007 | Endelman | |
| 7,192,387 | B2 | 3/2007 | Mendel | |
| 7,448,986 | B1 | 11/2008 | Porth | |
| 7,537,554 | B2 | 5/2009 | Zhuang | |
| 7,803,095 | B1 | 9/2010 | Lagree | |
| 7,871,359 | B2 | 1/2011 | Humble | |
| 7,878,955 | B1 | 2/2011 | Ehrlich | |
| 7,914,420 | B2 | 3/2011 | Daly | |
| 7,931,570 | B2 | 4/2011 | Hoffman | |
| 7,967,728 | B2 | 6/2011 | Zavadsky | |
| 8,162,802 | B2 | 4/2012 | Berg | |
| 8,249,714 | B1 | 8/2012 | Hartman | |
| 8,287,434 | B2 | 10/2012 | Zavadsky | |
| 8,303,470 | B2 | 11/2012 | Stewart | |
| 8,500,611 | B2 | 8/2013 | Hoffman | |
| 8,585,554 | B2 | 11/2013 | Shavit | |
| 8,641,585 | B2 | 2/2014 | Lagree | |
| 8,812,075 | B2 | 8/2014 | Nguyen | |
| 8,852,062 | B2 | 10/2014 | Dorsay | |
| 8,911,328 | B2 | 12/2014 | Alessandri | |
| 9,011,291 | B2 | 4/2015 | Birrell | |
| 9,022,909 | B2 | 5/2015 | Kermath | |
| 9,199,123 | B2 | 12/2015 | Solow | |
| 9,283,422 | B2 | 3/2016 | Lagree | |
| 9,533,184 | B1 | 1/2017 | Lagree | |
| 10,046,193 | B1 | 8/2018 | Aronson | |
| 10,155,129 | B2 | 12/2018 | Lagree | |
| 2001/0056011 | A1 | 12/2001 | Endelman | |
| 2002/0025888 | A1 | 2/2002 | Germanton | |
| 2002/0025891 | A1 | 2/2002 | Colosky, Jr. | |
| 2002/0082146 | A1 | 6/2002 | Stearns | |
| 2002/0137607 | A1 | 9/2002 | Endelman | |
| 2003/0119635 | A1 | 6/2003 | Arbuckle | |
| 2004/0043873 | A1 | 3/2004 | Wilkinson | |
| 2005/0085351 | A1 | 4/2005 | Kissel | |
| 2005/0130810 | A1 | 6/2005 | Sands | |
| 2005/0164853 | A1 | 7/2005 | Naidus | |
| 2005/0164856 | A1 | 7/2005 | Parmater | |
| 2006/0046914 | A1 | 3/2006 | Endelman | |
| 2006/0105889 | A1 | 5/2006 | Webb | |
| 2006/0183606 | A1 | 8/2006 | Parmater | |
| 2006/0199712 | A1 | 9/2006 | Barnard | |
| 2007/0087921 | A1 | 4/2007 | Graham | |
| 2007/0202992 | A1 | 8/2007 | Grasshoff | |
| 2007/0224582 | A1 | 9/2007 | Hayashino | |
| 2007/0270293 | A1 | 11/2007 | Zhuang | |
| 2008/0051256 | A1 | 2/2008 | Ashby | |
| 2008/0058174 | A1 | 3/2008 | Barnard | |
| 2008/0070765 | A1 | 3/2008 | Brown | |
| 2008/0139975 | A1 | 6/2008 | Einav | |
| 2008/0242519 | A1 | 10/2008 | Parmater | |
| 2008/0248935 | A1 | 10/2008 | Solow | |
| 2008/0254952 | A1 | 10/2008 | Webb | |
| 2009/0005698 | A1 | 1/2009 | Lin | |
| 2009/0023561 | A1 | 1/2009 | Ross | |
| 2009/0291805 | A1 | 11/2009 | Blum | |
| 2009/0312152 | A1 | 12/2009 | Kord | |
| 2010/0016131 | A1 | 1/2010 | Hoffman | |
| 2010/0125026 | A1 | 5/2010 | Zavadsky | |
| 2010/0144499 | A1 | 6/2010 | Graham | |
| 2010/0227748 | A1 | 9/2010 | Campanaro | |
| 2010/0267524 | A1 | 10/2010 | Stewart | |
| 2011/0009249 | A1 | 1/2011 | Campanaro | |
| 2011/0018233 | A1 | 1/2011 | Senner | |
| 2011/0184559 | A1 | 1/2011 | Benabid | |
| 2011/0039665 | A1 | 2/2011 | Dibble | |
| 2011/0077127 | A1 | 3/2011 | Ishii | |
| 2011/0143898 | A1 | 6/2011 | Trees | |
| 2011/0152045 | A1 | 6/2011 | Home | |
| 2011/0166002 | A1 | 7/2011 | Savsek | |
| 2011/0172069 | A1 | 7/2011 | Gerschefske | |
| 2012/0015334 | A1 | 1/2012 | Hamilton | |
| 2012/0088634 | A1 | 4/2012 | Heidecke | |
| 2012/0143020 | A1 | 6/2012 | Bordoley | |
| 2012/0190505 | A1 | 7/2012 | Shavit | |
| 2012/0202656 | A1 | 8/2012 | Dorsay | |
| 2012/0228385 | A1 | 9/2012 | Deluca | |
| 2012/0295771 | A1 | 11/2012 | Lagree | |
| 2013/0072353 | A1 | 3/2013 | Alessandri | |
| 2013/0150216 | A1 | 6/2013 | Bell | |
| 2013/0196835 | A1 | 8/2013 | Solow | |
| 2013/0210578 | A1 | 8/2013 | Birrell | |
| 2013/0289889 | A1 | 10/2013 | Yuen | |
| 2014/0011645 | A1 | 1/2014 | Johnson | |
| 2014/0066257 | A1 | 3/2014 | Shavit | |
| 2014/0087922 | A1 | 3/2014 | Bayerlein | |

(56) References Cited

U.S. PATENT DOCUMENTS

| | | | |
|---|---|---|---|
| 2014/0100089 | A1 | 4/2014 | Kermath |
| 2014/0121076 | A1 | 5/2014 | Lagree |
| 2014/0121078 | A1 | 5/2014 | Lagree |
| 2014/0121079 | A1 | 5/2014 | Lagree |
| 2014/0141948 | A1 | 5/2014 | Aronson |
| 2014/0148715 | A1 | 5/2014 | Alexander |
| 2014/0213415 | A1 | 7/2014 | Parker |
| 2015/0012111 | A1 | 1/2015 | Contreras-Vidal |
| 2015/0024914 | A1 | 1/2015 | Lagree |
| 2015/0057127 | A1 | 2/2015 | Lagree |
| 2015/0065318 | A1 | 3/2015 | Lagree |
| 2015/0072841 | A1 | 3/2015 | Lagree |
| 2015/0105223 | A1 | 4/2015 | Bissu |
| 2015/0141204 | A1 | 5/2015 | Lagree |
| 2015/0217164 | A1 | 8/2015 | Lagree |
| 2015/0220523 | A1 | 8/2015 | Lagree |
| 2015/0246263 | A1 | 9/2015 | Campanaro |
| 2015/0297944 | A1 | 10/2015 | Lagree |
| 2015/0329011 | A1 | 11/2015 | Kawai |
| 2015/0343250 | A1 | 12/2015 | Lagree |
| 2015/0360068 | A1 | 12/2015 | Lagree |
| 2015/0360083 | A1 | 12/2015 | Lagree |
| 2015/0360113 | A1 | 12/2015 | Lagree |
| 2015/0364058 | A1 | 12/2015 | Lagree |
| 2015/0364059 | A1 | 12/2015 | Marks |
| 2015/0367166 | A1 | 12/2015 | Lagree |
| 2016/0008657 | A1 | 1/2016 | Lagree |
| 2016/0346593 | A1 | 1/2016 | Lagree |
| 2016/0059060 | A1 | 3/2016 | Lagree |
| 2016/0059061 | A1 | 3/2016 | Lagree |
| 2016/0074691 | A1 | 3/2016 | Pearce |
| 2016/0096059 | A1 | 4/2016 | Lagree |
| 2016/0166870 | A1 | 6/2016 | Lagree |
| 2016/0193496 | A1 | 7/2016 | Lagree |
| 2016/0256733 | A1 | 9/2016 | Lagree |
| 2016/0271452 | A1 | 9/2016 | Lagree |
| 2016/0317858 | A1 | 11/2016 | Lagree |
| 2016/0361602 | A1 | 12/2016 | Lagree |
| 2017/0014664 | A1 | 1/2017 | Lagree |
| 2017/0014672 | A1 | 1/2017 | Lagree |
| 2017/0036057 | A1 | 2/2017 | Lagree |
| 2017/0036061 | A1 | 2/2017 | Lagree |
| 2017/0043210 | A9 | 2/2017 | Lagree |
| 2017/0065846 | A1 | 3/2017 | Lagree |
| 2017/0072252 | A1 | 3/2017 | Lagree |
| 2017/0087397 | A1 | 3/2017 | Lagree |
| 2017/0100625 | A1 | 4/2017 | Lagree |
| 2017/0100629 | A1 | 4/2017 | Lagree |
| 2017/0106232 | A1 | 4/2017 | Lagree |
| 2017/0113091 | A1 | 4/2017 | Lagree |
| 2017/0120101 | A1 | 5/2017 | Lagree |
| 2017/0144013 | A1 | 5/2017 | Lagree |
| 2017/0157452 | A1 | 6/2017 | Lagree |
| 2017/0157458 | A1 | 6/2017 | Lagree |
| 2017/0165518 | A1 | 6/2017 | Lagree |
| 2017/0165555 | A1 | 6/2017 | Lagree |
| 2017/0189740 | A1 | 7/2017 | Lagree |
| 2017/0189741 | A1 | 7/2017 | Lagree |
| 2017/0209728 | A1 | 7/2017 | Lagree |
| 2017/0239526 | A1 | 8/2017 | Lagree |
| 2017/0246491 | A1 | 8/2017 | Lagree |
| 2017/0246499 | A1 | 8/2017 | Lagree |
| 2017/0296865 | A1 | 10/2017 | Lagree |
| 2017/0304673 | A1 | 10/2017 | Lagree |
| 2017/0326406 | A1 | 11/2017 | Lagree |
| 2017/0340947 | A1 | 11/2017 | Lagree |
| 2017/0354840 | A1 | 12/2017 | Lagree |
| 2018/0015319 | A1 | 1/2018 | Lagree |
| 2018/0021621 | A1 | 1/2018 | Lagree |
| 2018/0021655 | A1 | 1/2018 | Lagree |
| 2018/0036583 | A1 | 2/2018 | Lagree |
| 2018/0056109 | A1 | 3/2018 | Lagree |
| 2018/0056133 | A1 | 3/2018 | Lagree |
| 2018/0111020 | A1 | 4/2018 | Lagree |
| 2018/0111033 | A1 | 4/2018 | Lagree |
| 2018/0117392 | A1 | 5/2018 | Lagree |
| 2018/0133532 | A1 | 5/2018 | Lagree |
| 2018/0133533 | A1 | 5/2018 | Lagree |
| 2018/0133534 | A1 | 5/2018 | Lagree |
| 2018/0133542 | A1 | 5/2018 | Lagree |

FOREIGN PATENT DOCUMENTS

| | | | |
|---|---|---|---|
| KR | 1020040097734 | A | 11/2004 |
| WO | 2004096376 | A1 | 11/2004 |
| WO | 2014084742 | A1 | 6/2014 |

OTHER PUBLICATIONS http://www.cognionics.com/index.php/products/mini-systems/multi-position-dry-headband; Cognionics Multi-Position Dry EEG Headband; Jun. 14, 2016.

http://www.cognionics.com/index.php/products/hd-eeg-systems/mobile-eeg-cap; Cognionics Mobile-72 Wireless EEG System; Jun. 14, 2016.

http://www.cognionics.com/index.php/products/hd-eeg-systems/72-channel-system; Cognionics HD-72 Overview; Jun. 14, 2016.

http://www.cognionics.com/index.php/products/mini-systems/dry-eeg-headband; Cognionics Dry EEG Headband; Jun. 14, 2016.

http://www.brainproducts.com/productdetails.php?id=63&tab=1; LiveAmp Overview; Jun. 14, 2016.

http://www.puzzlebox.io/brainstorms/; Puzzlebox Brainstorms Website Article; Jun. 13, 2016.

http://tera.lunar-europe.com; TERA Fitness Mat; Lunar Europe; Jun. 8, 2014.

https://www.youtube.com/watch?v=xj2xuGsB3yo; Screenshot of YouTube Video "Iphone free App (Dec. 16, 2010) Finger Balance"; tuuske; Dec. 16, 2010.

PCT International Search Report and Written Opinion from International Searching Authority for PCT/US2016/022888, dated Jul. 25, 2016.

PCT Preliminary Report on Patentability from International Searching Authority for PCT/US2016/022888, dated Sep. 28, 2017.

PCT International Search Report and Written Opinion from International Searching Authority for PCT/US2015/047763, dated Nov. 19, 2015.

PCT International Search Report and Written Opinion from International Searching Authority for PCT/US2015/047746, dated Nov. 19, 2015.

PCT International Search and Written Opinion from International Searching Authority for PCT/US2017/041638, dated Sep. 28, 2017.

PCT Preliminary Report on Patentability from International Searching Authority for PCT/US2017/041638, dated Jan. 24, 2019.

* cited by examiner

EXERCISE MACHINE REVERSIBLE RESISTANCE SYSTEM

CROSS REFERENCE TO RELATED APPLICATIONS

The present application is a continuation of U.S. application Ser. No. 17/139,209 filed on Dec. 31, 2020 which issues as U.S. Pat. No. 11,298,582 on Apr. 12, 2022, which is a continuation of U.S. application Ser. No. 16/686,343 filed on Nov. 18, 2019 now issued as U.S. Pat. No. 10,881,896, which is a continuation of U.S. application Ser. No. 15/871,950 filed on Jan. 15, 2018 now issued as U.S. Pat. No. 10,478,663, which is a continuation of U.S. application Ser. No. 14/840,910 filed on Aug. 31, 2015 now issued as U.S. Pat. No. 9,868,019, which claims priority to U.S. Provisional Application No. 62/043,503 filed Aug. 29, 2014. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND OF THE INVENTION

Field of the Invention

The present invention relates generally to an exercise machine and more specifically it relates to an exercise machine reversible resistance system for reversing the directional force of resistance against an exercise implement before, during, or after the performance of a routine of one or more exercises.

Description of the Related Art

Any discussion of the related art throughout the specification should in no way be considered as an admission that such related art is widely known or forms part of common general knowledge in the field.

Exercise is human physical activity that enhances or maintains overall physical health of an exerciser. Exercise is performed to increase muscle strength, improve balance, improve cardiovascular efficiency, and to aid in weight loss.

Cardiovascular exercises are intended to improve circulatory and respiratory performance and health by raising the heart rate for an extended period of time, increasing oxygenation and calorie burn. Within the fitness industry, cardiovascular exercise as often referred to as "cardio". Typical cardio exercise equipment found in gyms includes treadmills, stationary bikes, elliptical trainers, and stair climbers. Cardio exercises performed without the aid of specialized apparatuses include running and swimming.

Strength exercises are intended to increase the ability for muscles to perform more work. The exercises are practiced consistently over weeks or months. Strength exercises are typically performed in short but high intensity muscle bursts, rather than the long duration of cardio exercises. Strength training is intended to break down the muscles targeted by the exercise. The subsequent repair of muscle tissue after training is achieved by increased localized blood circulation that delivers nutrients and oxygen, both of which promote repair and growth of the muscle beyond its size and strength prior to exercise.

Strength exercise machines are apparatuses or devices providing for fixed or adjustable amounts of resistance, and which are used during physical activity to enhance the strength or conditioning effects of the performed exercises.

Myriad apparatuses have been made available by many manufacturers, each apparatus intended to work one targeted muscle or group of muscles. For instance, a bicep curl machine is intended to exercise only the bicep muscles, while a chest press machine is intended to primarily exercise the chest muscles, but to a lesser degree, shoulder and triceps muscles.

Strength exercise apparatuses may incorporate as the resistance source free weights, for example, barbells, dumbbells or stacked weights, resistance springs or bands, or position the exerciser so as to use the exerciser's own body weight as the weight resistance source.

Contemporary methods of exercising against a workload are many, and well known to those skilled in the art. One method of creating a direct vertical workload is an exerciser's application of force to lift a dead weight from a resting position to a higher vertical position. Another method of creating a horizontal workload is to redirect a vertical workload along a horizontal vector using a pulley or mechanical linkage. Yet another method of creating a workload in any direction is to apply a force opposite the force axis of a variable resistance means, such as a spring or elastic resistance band.

Still another method of creating a workload is to require a continuous cycle of lifting one's own body weight. For instance, a person exercising on a motorized treadmill is required to increase or decrease the elevation through which they lift their body with each step, and/or to increase or decrease the speed or length of stride in order to maintain their relatively stationary position upon the moving treadmill belt. Increasing the pitch of the treadmill belt further causes the exerciser to increase their work by lifting their body weight higher with each step in order to maintain their position on a treadmill.

Those skilled in the art will recognize that most all exercise apparatuses provide for continuous or cyclical exercising in one primary direction. For instance, an bicep curl machine is operated by an exerciser repeatedly flexing their bicep to raise their lower arm against a prescribed weight, then by slowly releasing the bicep muscle flex, allows the re-extension of their lower arm to return the weight to the starting point, then repeat the cycle for a prescribed number of times.

On the other hand, a triceps apparatus works opposite to a bicep curl apparatus in that the primary work is performed by flexing the triceps to extend the forearm to substantially align with the upper arm while working against a weight or resistance. By slowly relaxing the triceps, the weight is returned to its starting point as the lower arm assumes a decreasing angle relative to the upper arm.

As can readily be understood in the foregoing descriptions, exercise machines are intended to deliver a workload in one direction only. The primary work cycle on a bicep machine is achieved when the hand working against the resistance approaches the shoulder, while the primary work cycle on a triceps machine is achieved when the hand working against the resistance moves away from the shoulder. Therefore, a bicep machine does not appreciably exercise triceps, and a triceps machine does not appreciably exercise the biceps.

Another form of exercise produces a mixed benefit of combining cardio and strength training. Known to those skilled in the art, circuit training is a form of exercise that requires the exerciser to continuously work against resistance for a prolonged period, as previously described in cardio exercises, yet also incorporates a routine of large number of exercises that are performed in a rapid sequence, without any appreciable rest between each exercise.

One variation of circuit training is sometimes referred to as interval training wherein the exerciser generally performs the same exercise for a period of specific duration, similar to cardio exercising, but varies the resistance level throughout the routine period to substantially increase the exerciser's workload for short duration, high intensity bursts, then decrease the workload during a moderate recovery period whereby the cardio exercise intensity is maintained until a subsequent burst. The exerciser repeats this high/low intensity cycle until the end of the training period.

A disadvantage of attempting to perform circuit or interval training on a variety of exercise apparatuses by immediately and without an appreciable rest period, moving from one apparatus for one exercise, to another apparatus for a subsequent exercise is that in a typical gym environment, there will be another exerciser already working out on the next apparatus in the sequence, forcing the circuit exerciser to wait until the apparatus is available. This breaks the intended benefits of the continuous cycle of circuit training.

Another disadvantage of performing circuit training using multiple apparatuses in sequence within a gym environment is that even if the next apparatus is vacant, the proper weight, resistance level, or direction of resistance must be re-set for each exerciser. In many instances, this is time consuming, confusing, and the proper weight setting cannot be readily determined. Again, the break in the circuit sequence reduces the intended advantages of the circuit training session.

A disadvantage of attempting to perform a variation of circuit training upon a single exercise apparatus is that an exerciser must stop the exercise routine, most often by having to dismount the apparatus in order to change the existing resistance settings to new settings or to reverse the direction of resistance. The exerciser then re-mounts the apparatus and re-establishes proper positioning before continuing a new exercise at the new resistance setting. However, after a short period of performing a first exercise, often merely a minute or two, the exerciser would have to again dismount and change the resistance settings or the direction of resistance for a second exercise—then repeat the entire process with many additional exercises included in the particular routine. It often takes more time to change the resistance settings than the period of time the exerciser will actually perform the new exercise at the new setting.

Still another disadvantage of all of the exercise machines and Pilates apparatuses just described is that the resistance is unidirectional. In other words, none of the machines provide for an exerciser to immediately change the direction of the resistance force.

As an example, the rotating belt of a motorized treadmill is intended to move such that an exerciser, facing the front of the machine, can walk or run at different speeds, on a flat, or "uphill". Reversing the rotation of the rotating belt would require the exerciser to begin walking or running backwards, and possibly "downhill". Not only would this be an unnatural exercise, reversing a treadmill belt during exercise would be dangerous, and would likely be the source of many injuries.

As another example, a pull down machine to exercise the latissimus dorsi muscles provides a seat upon which an exerciser sits, and an overhead bar attached to a cable. The cable is threaded through a pulley on the machine, and is attached to weights. When an exerciser pulls down the overhead bar to work the latissimus dorsi or back muscles, the downward direction of their pull is reversed through the pulley, and they are actually pulling the weights that are attached to the cable upward from the floor. On the other hand, there is no provision to allow the exerciser to switch resistance direction so they can push upward on the bar and lift the weights to exercise the shoulders as would be provided by a shoulder press machine. Pushing upward provides no work resistance.

Yet another exemplary embodiment of the present invention is an improved exercise apparatus with a force reversing system providing for a plurality of exercise resistance springs affixed to an apparatus structure, a means providing for an exerciser to input an exercising force in one moveable direction sufficient to overcome one or more of the resistance springs, and a system providing for an exerciser to immediately reverse the direction of motion against which a counteracting resistance force will be applied. For instance, an exerciser's upward force movement as required to work against the spring resistance can be reversed to a downward force required to work against the spring resistance.

Another object of the present invention is an improved Pilates apparatus comprising a substantially longitudinal frame, an idler pulley affixed at substantially one end of the apparatus, a driven pulley on a drive shaft affixed at substantially the opposed end of the apparatus, a drive belt affixed to at least the idler and driven pulleys, and therebetween, an exercise carriage slidable along the longitudinal axis of the apparatus, the carriage being optionally engageable along the length of either side of the drive belt, thereby allowing an exerciser to select which direction the slidable carriage and correspondingly, the rotational direction of the driven pulley will move responsive to an exercise force input exerted upon the slidable platform. The reverser as currently illustrated is 'self energizing'. This means that the more force an exerciser applies to the platform, pull the harder it tries to engage. A beneficial side effect is that if the exerciser pushes the rollable platform in the wrong direction, it disengages, thus preventing the platform back driving the spring mechanism.

Those skilled in the art will immediately recognize the deficiencies just described, and will understand that a sufficiently large number of machines to allow exercising of each major muscle group housing many machines requires leasing a large and expansive area for a functional gym or Pilates studio. They will appreciate that one machine capable of providing resistance for a wide variety of exercises allows for more economically efficient operations.

Further, fitness experts and gym operations will appreciate the commercial advantages of a new and improved exercise apparatus that provides for immediate and precise changing of the resistance level without considerable interruption to a workout routine, and a system of immediately reversing the direction of resistance to increase the number of muscles and muscle groups that may be exercised without dismounting the apparatus, thereby obviating the need to make complicated changeovers to the apparatus, or to move to another machine to perform a different exercise.

Because of the inherent problems with the related art, there is a need for a new and improved exercise machine reversible resistance system for reversing the directional force of resistance against an exercise implement before, during, or after the performance of a routine of one or more exercises.

BRIEF SUMMARY OF THE INVENTION

Provided herein is an exercise machine reversible resistance system which includes an exercise machine which has a movable exercise implement. The exercise implement is adapted to move with a drive belt which is connected at one end to a drive pulley and at the other end to an idler pulley. The exercise implement includes a clutch which selectively engages with different positions on the inner surface of the drive belt to adjust a direction of resistance applied against movement of the exercise implement. The clutch is movable between three positions: a first position in which the clutch is disengaged and no resistance is applied against the exercise implement, a second position in which the clutch is engaged with a first portion of the drive belt and resistance is applied against movement of the exercise implement in a first direction, and a third position in which the clutch is engaged with a second portion of the drive belt and resistance is applied against movement of the exercise implement in a second direction.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
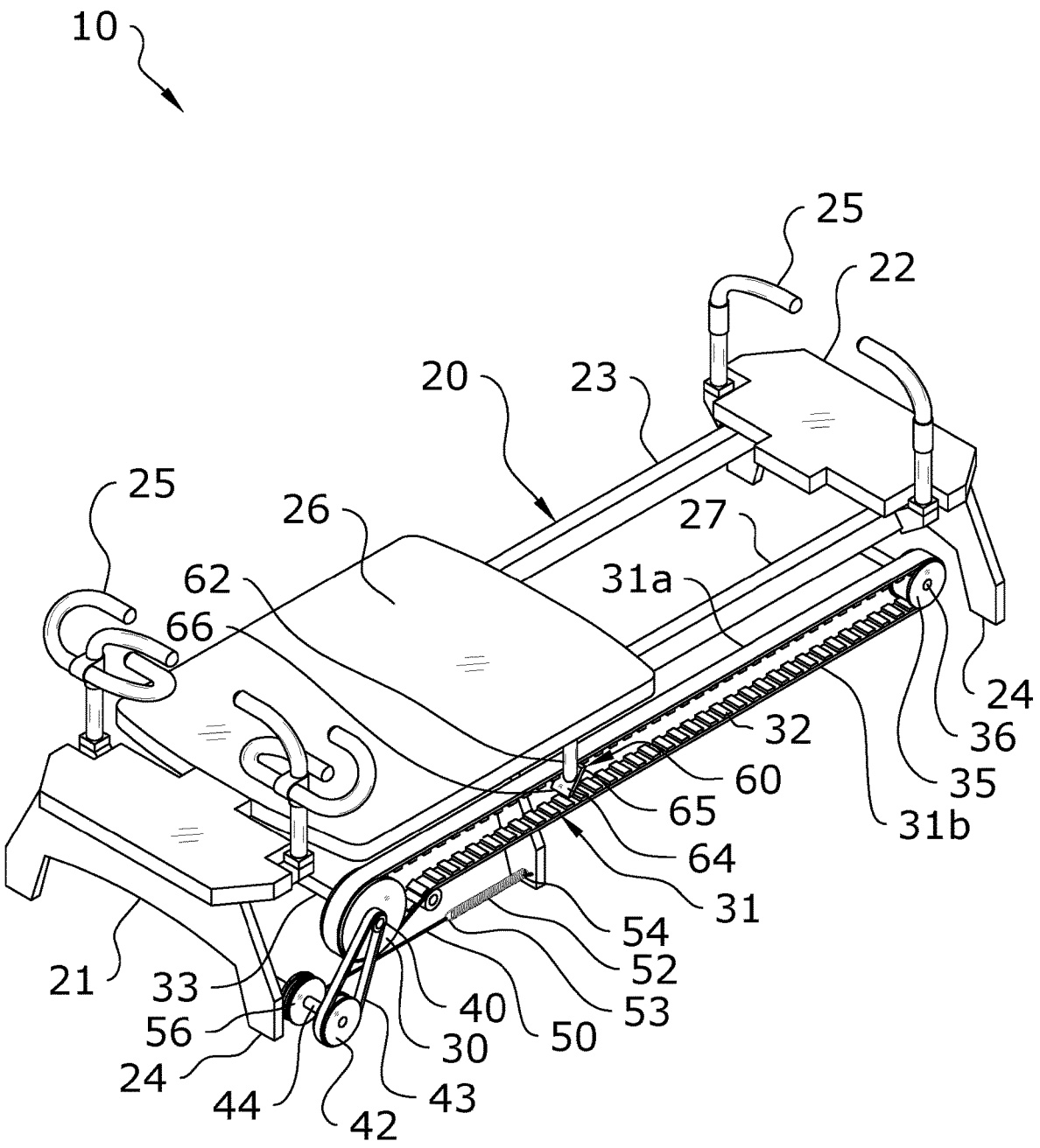
FIG. 1 is an upper perspective view of an exemplary embodiment of the present invention.

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments" is not exhaustive and does not require that all embodiments include the discussed feature, advantage or mode of operation.

Turning now descriptively to the drawings, in which similar reference characters denote similar elements throughout the several views, FIGS. 1 through 5 illustrate an exercise machine reversible resistance system 10, which comprises a frame 23 having a first end and a second end, an elongated member 31 movably positioned upon the frame 23, a resistance device 52 connected to the elongated member 31, an exercise implement 26 movably connected to the frame 23, and a clutch 60 connected to the exercise implement 26. The elongated member 31 has a first run 31*a* and a second run 31*b* between the first end and the second end of the frame as illustrated in FIGS. 1 through 5. When the first run 31*a* moves in a first direction the second run 31*b* moves in a second direction that is substantially opposite of the first direction and when the first run 31*a* moves in the second direction the second run 31*b* moves in the first direction. The resistance device 52 applies a resistance force to the elongated member 31 in the second direction relative to the first run 31*a* and applies the resistance force to the elongated member 31 in the first direction relative to the second run 31*b*.

Figure 2:
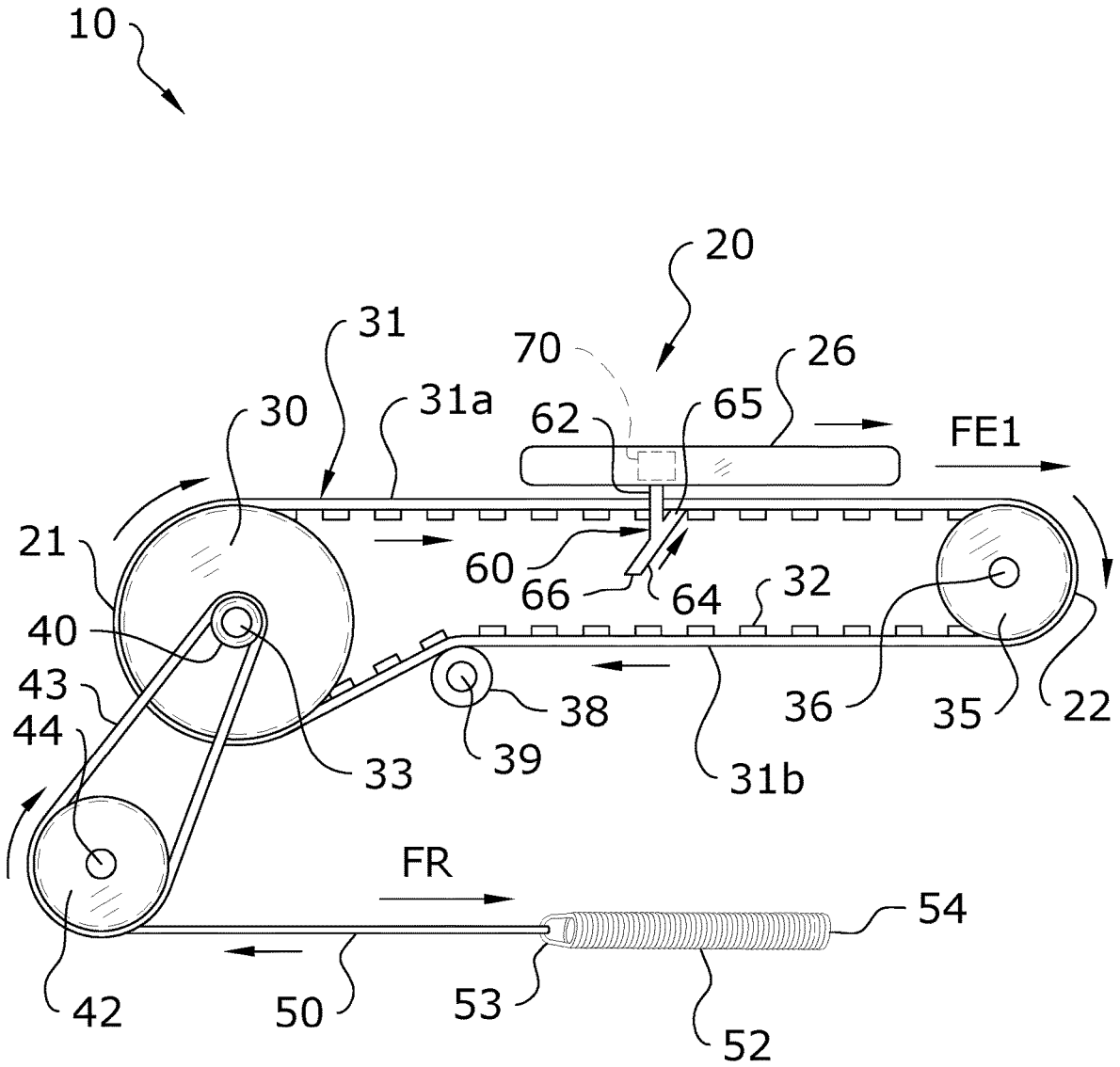
FIG. 2 is a side sectional view of a horizontal embodiment of the present invention in a first configuration.
Figure 3:
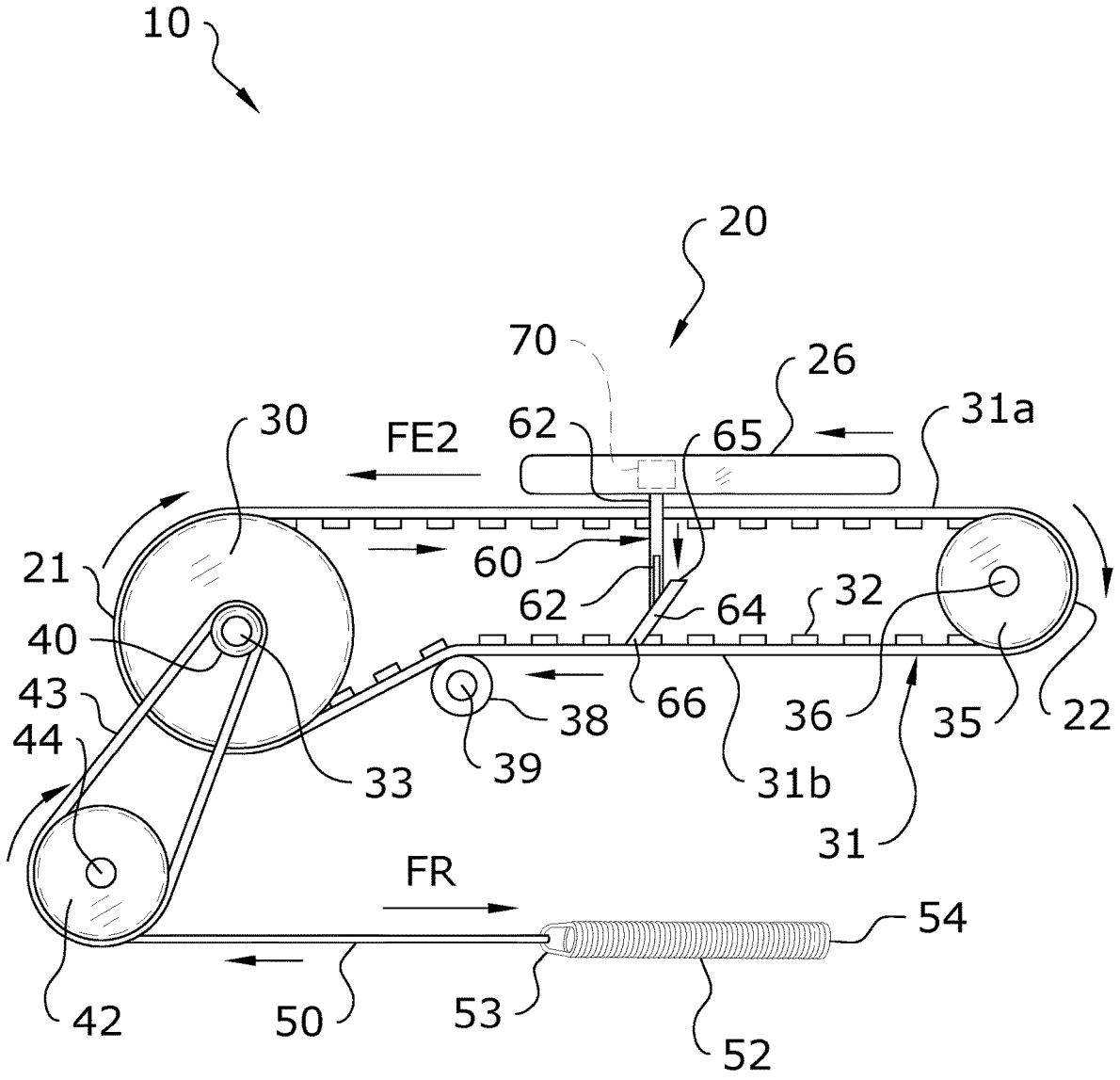
FIG. 3 is a side sectional view of a horizontal embodiment of the present invention in a second configuration.
Figure 4:
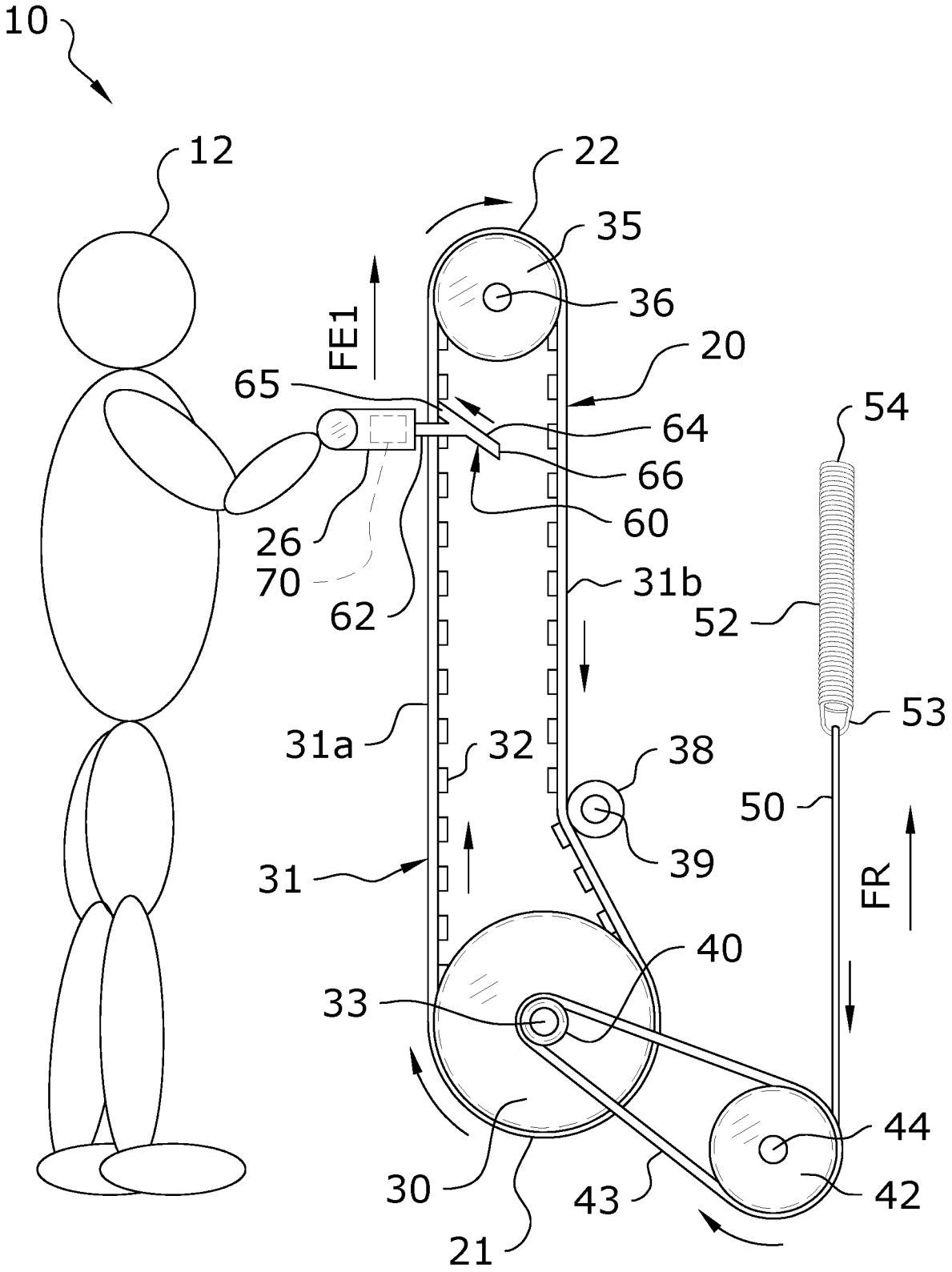
FIG. 4 is a side sectional view of a vertical embodiment of the present invention in a first configuration.
Figure 5:
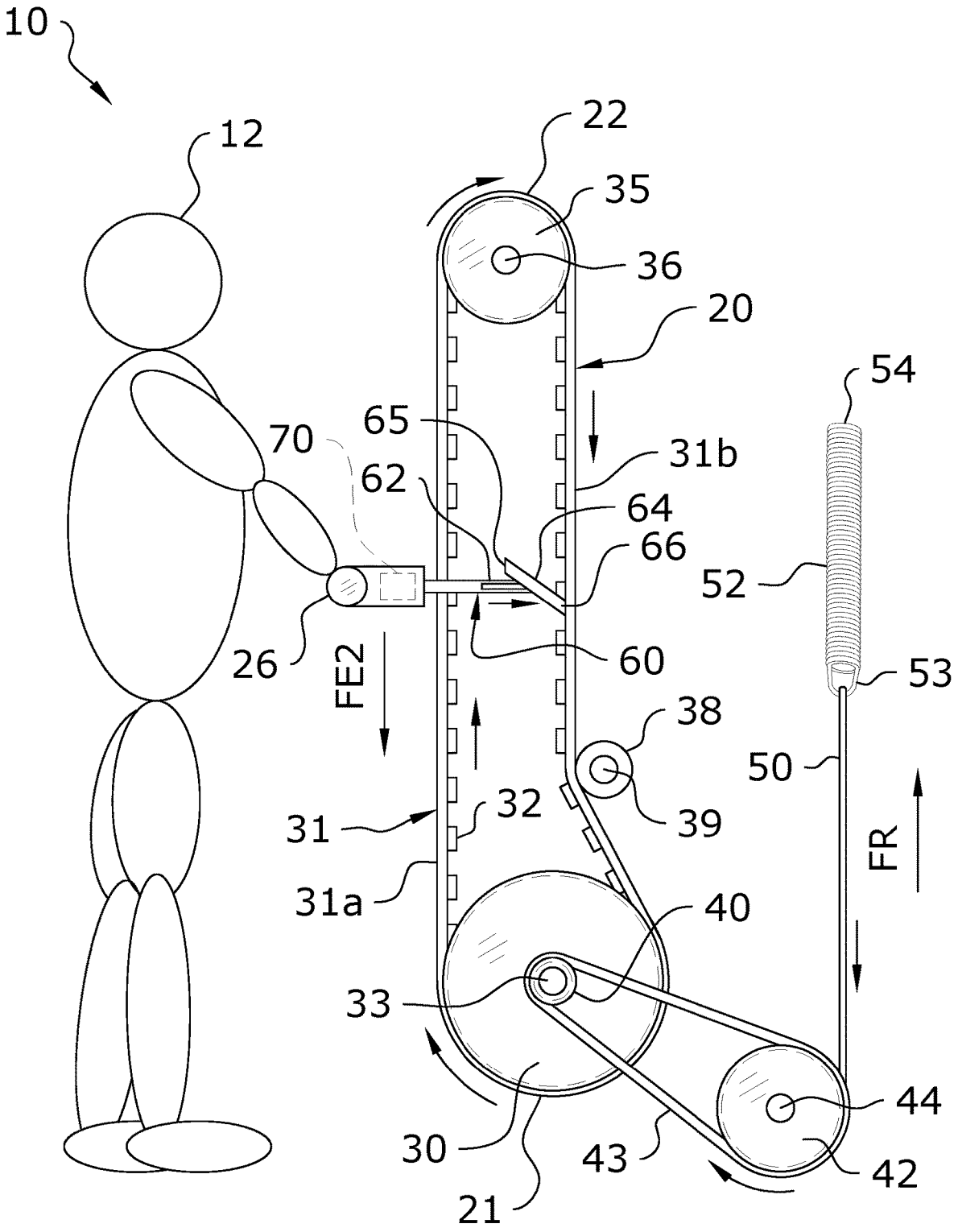
FIG. 5 is a side sectional view of a vertical embodiment of the present invention in a second configuration.
Figure 6:
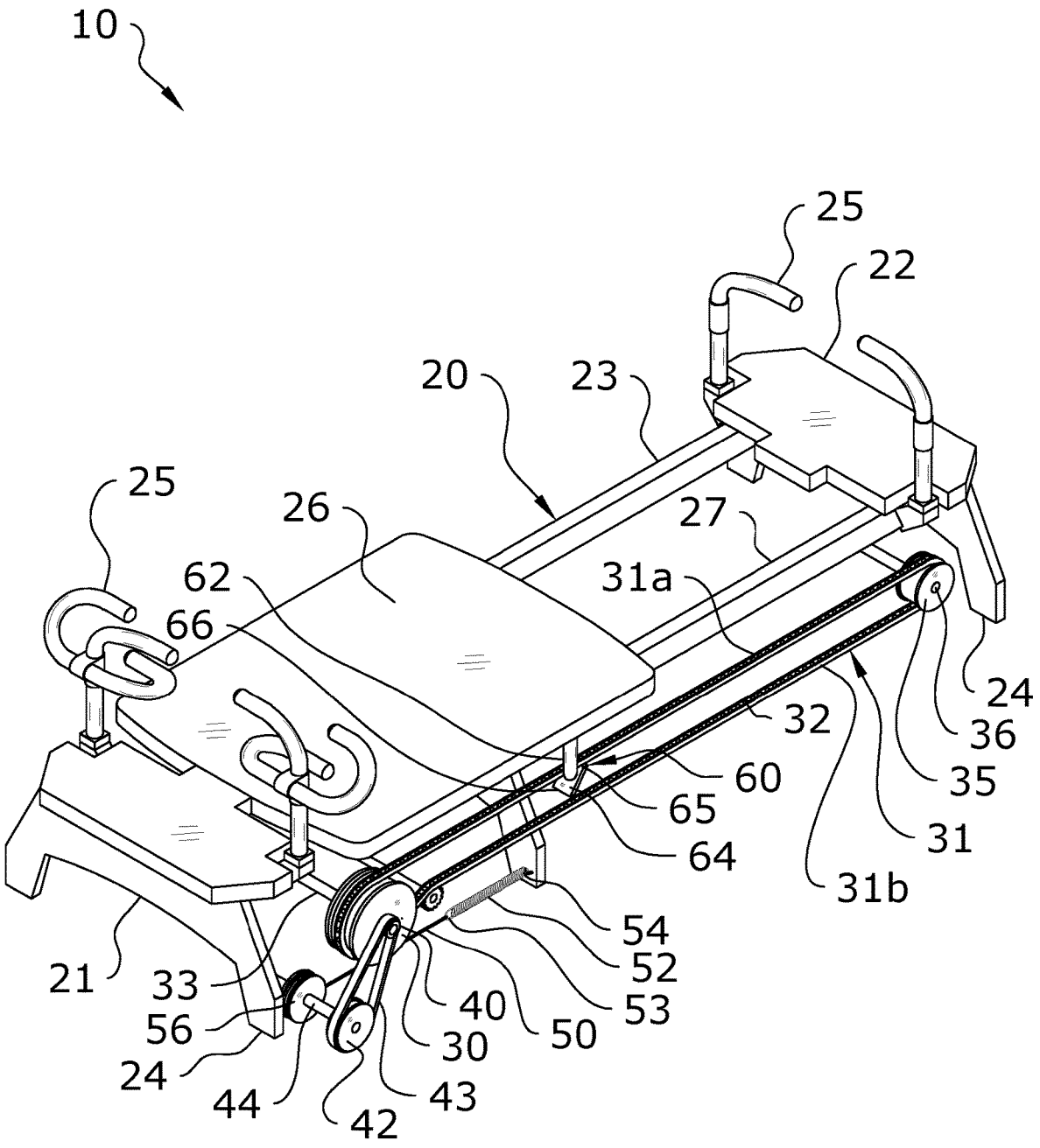
FIG. 6 is an upper perspective view of an additional exemplary embodiment of the present invention in which the elongated member is a chain.

The clutch 60 is adapted to selectively engage the first run 31*a* or the second run 31*b* of the elongated member 31. The exercise implement 26 receives the resistance force in the second direction when the clutch 60 is engaged to the first run 31*a* as shown in FIGS. 1, 2 and 4 of the drawings. The exercise implement 26 receives the resistance force in the first direction when the clutch 60 is engaged to the second run 31*b* as shown in FIGS. 3 and 5 of the drawings. The clutch 60 is preferably comprised of a linear clutch to move in a linear manner.

The first run 31*a* and the second run 31*b* are preferably substantially parallel with respect to one another as illustrated in FIGS. 1 through 5. The first run 31*a* and the second run 31*b* may be horizontally aligned (FIGS. 1 through 3), vertically aligned (FIGS. 4, 5) or aligned at an angle between horizontal and vertical. The first run 31*a* may be positioned above, below, to the left or to the right of the second run 31*b*. The first run 31*a* is distally spaced apart from the second run 31*b*.

The elongated member 31 is comprised of an endless loop structure that rotates around a first wheel 30 and a second wheel 35. The first wheel 30 is rotatably connected to the frame 23 and the second wheel 35 is rotatably connected to the frame 23 distally spaced from the first wheel 30 as illustrated in FIGS. 1 through 5 of the drawings. The elongated member 31 is movably positioned upon the first wheel 30 and the second wheel 35, wherein the first run 31*a* and the second run 31*b* are positioned between the first wheel 30 and the second wheel 35. The elongated member 31 preferably includes a plurality of teeth 32 that are selectively engageable by the clutch 60. The plurality of teeth 32 preferably extend inwardly toward one another between the two opposing runs 31*a*, 31*b* as illustrated in FIGS. 1 through 5 of the drawings. The elongated member 31 may be comprised of a belt, chain or other elongated structure. The elongated member 31 is preferably comprised of a non-stretchable material.

The resistance device 52 may be directly connected to the elongated member 31 or indirectly connected to the elongated member 31. For example, the resistance device 52 may be connected to the first wheel 30 to apply the resistance force against rotation of the first wheel 30 in a first rotational direction. The resistance device 52 may be comprised of a bias member that is elongated and resilient (e.g. elastic member, spring).

The clutch 60 is comprised of an actuator 70 and an engagement portion 64 extending from the actuator 70. The actuator 70 may be comprised of a manually operated actuator (e.g. a lever) or a powered actuator (e.g. electric motorized actuator). The engagement portion 64 has a retracted position for engaging the first run 31*a* as shown in FIGS. 1, 2, 4 of the drawings. The engagement portion 64 of the clutch 60 also preferably has an extended position for engaging the second run 31*b* as shown in FIGS. 3, 5 of the drawings.

The invention in one embodiment is comprised of a frame 23 to which are connected a first wheel 30 and a second wheel 35. The first wheel 30 and second wheel 35 will generally be spaced-apart, though the distance by which they are separated will vary in different embodiments of the present invention. In the embodiment shown in the figures, the first wheel 30 is positioned at or near the first end 21 of the exercise machine 20 and the second wheel 35 is positioned at or near the second end 22 of the exercise machine 20.

An elongated member 31 is shown as connecting the first wheel 30 with the second wheel 35 such that rotation of the first wheel 30 will similarly rotate the freely-rotatable second wheel 35. The first wheel 30 includes a first run 31*a* and a second run 31*b*. It is noted that the particular locations along the inner surface of the elongated member 31 which comprise the first run 31*a* and second run 31*b* will vary as the elongated member 31 traverses the path between the first wheel 30 and second wheel 35. Thus, the same location on the inner surface of the elongated member 31 which comprises a first run 31*a* will comprise the second run 31*b* of the elongated member 31 at a different time depending on positioning of the elongated member 31 on the first wheel 30 and second wheel 35 at that particular time.

The elongated member 31 of the present invention may comprise various configurations, and should not be construed as limited by the exemplary figures. In a preferred embodiment as shown in the figures, the elongated member 31 comprises a belt having a plurality of teeth 32 extending along its inner surface. In other embodiments, the elongated member 31 could comprise a chain with a plurality of links, rather than teeth 32. In other embodiments, the elongated member 31 could comprise a flat surface without any projections such as teeth 32 as discussed herein.

The exercise machine 20 includes an exercise implement 26 which is freely-movable in at least two directions, such as by being movably connected to a frame 23 or rails 27. The exercise machine 20 may be free-standing, such as through use of support feet 24, or may be connected to another structure, such as in a cantilevered configuration.

A bias member 52 is interconnected with the exercise implement 26 as discussed herein such that the bias member 52 will exert resistance against movement of the exercise implement 26 in multiple directions depending on positioning of a clutch 60. The exercise implement 26 may comprise various structures, devices, and the like, and should not be construed as limited by the exemplary figures herein. FIGS. 1-3 illustrate an embodiment in which the exercise implement 26 comprises a movable carriage. FIGS. 4-5 illustrate an embodiment in which the exercise implement 26 comprises a handle 25. Various other types of exercise implements 26 may be utilized.

The clutch 60 of the present invention extends from the exercise implement 26; with the clutch 60 being movably connected to the exercise implement 26 in some embodiments. The clutch 60 is adapted to selectively engage with the first run 31*a* of the elongated member 31 to apply resistance against movement of the exercise implement 26 in a first direction and to selectively engage with the second run 31*b* of the elongated member 31 to apply resistance against movement of the exercise implement 26 in a second direction. Thus, use of the clutch 60 is operable to change the direction of resistance being applied against movement or manipulation of the exercise implement 26.

The clutch 60 may comprise various configurations and should not be construed as limited by the exemplary figures. In the exemplary embodiment shown in the figures, the clutch 60 comprises an extension portion 62 which is connected at a first end to the exercise implement 26 and at a second end to an engagement portion 64. The extension portion 62 may extend vertically downward as shown in the figures, or may extend in different orientations. The engagement portion 64 is illustrated as extending diagonally with respect to the downwardly-extending extension portion 62, with the first end 65 of the engagement portion 64 being adapted to engage with the first run 31*a* of the elongated member 31 and the second end 66 of the engagement portion 64 being adapted to engage with the second run 31*b* of the elongated member 31.

The manner in which resistance from the bias member 52 is transferred to be applied against movement of the exercise implement 26 will vary in different embodiments. One such embodiment is illustrated in the figures; however, the present invention should not be construed as being limited in any respect by the exemplary embodiment. There are numerous manners in which the resistance force of the bias member 52 may be transferred to be applied against the exercise implement 26.

As shown in FIGS. 1-5, one such embodiment comprises the use of gear reduction pulleys 40, 42. In this exemplary embodiment, a first gear reduction pulley 40 shares the same drive shaft 33 as the first wheel 30 such that the first gear reduction pulley 40 and the drive shaft 33 are concentric. The first gear reduction pulley 40 will generally comprise a smaller diameter than the first wheel 30 as shown in the figures.

A second gear reduction pulley 42 is connected to the exercise machine 20, such as its frame 23, by a gear reduction shaft 44. The first gear reduction pulley 40 is connected to the second gear reduction pulley 42 by a gear reduction belt 43 such that the first and second gear reduction pulleys 40, 42 rotate together. In the embodiment shown in the figures, the second gear reduction pulley 42 is larger in diameter than the first gear reduction pulley 40.

A separate resistance pulley 56 is illustrated as sharing the same gear reduction shaft 44 as the second gear reduction pulley 42, with the resistance pulley 56 being concentric with the second gear reduction pulley 42. The resistance pulley 56 may comprise a smaller diameter than the first wheel 30 as shown in the figures. The resistance pulley 56 and second gear reduction pulley 42 may comprise substantially the same diameter as shown in the figures, or may comprise different diameters.

The resistance pulley 56 is interconnected with the bias member 52 of the present invention. In some embodiments, the bias member 52 may be directly connected to the resistance pulley 56. In other embodiments, a separate bias connector 50 may be provided which connects between the bias member 52 and the resistance pulley 56. As shown in the figures, one embodiment of the bias connector 50 is comprised of a cable, with the cable being connected at one end to the resistance pulley 56 and at the other end to the bias member 52. The bias member 52 may comprise various structures known to exert resistance, such as a spring as shown in the figures.

To maintain tension on the drive belt 30, a tensioner pulley 38 may be provided which exerts force against the drive belt 30 to maintain its tension as shown in the figures. The tensioner pulley 38 may be located anywhere along the length of the drive belt 30, including embodiments which exert tension against the upper portion of the drive belt 30 and embodiments (such as shown in the figures) which exert tension against the lower portion of the drive belt 30. The tensioner pulley 38 will preferably be mounted on its own tensioner shaft 39; with the tensioner shaft 39 being connected to the exercise machine 20, such as to its frame 23.

The exercise machine reversible resistance system 10 is adapted to transition between a push-force configuration shown in FIGS. 2 and 4, in which the exercise implement 26 is resisted as it is moved in a first direction FE1, and a pull-force configuration shown in FIGS. 3 and 5, in which the exercise implement 26 is resisted as it is moved in a second direction FE2. As illustrated throughout the figures, the first direction FE1 is opposite with respect to the second direction FE2.

FIG. 1 is an exemplary upper perspective view of the present invention. While this figure illustrates the exercise machine 20 as comprising a Pilates machine configuration, various types of other exercise machines 20 may be utilized as discussed herein. An exercise implement 26 is provided as part of the exercise machine 20, and may be connected to any portion of the exercise machine 20. The positioning of the exercise implement 26 will vary depending on the type of exercise machine 20 being utilized.

Any type of exercise machine 20 which utilizes an exercise implement 26 and bias members 52, such as rowing machines, weight lifting machines, universal exercise machines, press machines, squat machines, curl machines, triceps machines, dip machines, elliptical trainers, and the like. Thus, the present invention should not be construed as being limited to any particular type of exercise machine 20 or exercise implement 26. By way of example, FIGS. 1-3 illustrate the present invention being utilized in combination with a Pilates machine. As an additional example, FIGS. 4-5 illustrate the present invention being utilized in combination with an exercise machine 20 adapted to function as either a curl machine or a triceps machine depending on its configuration.

FIG. 2 is an exemplary diagram showing a side view of an exercise machine reversible resistance system 10 which is in a push-force configuration. More specifically, in the push-force exercise configuration as shown in FIG. 1, an elongated member 31 is installed around a first wheel 30 and a second wheel 35. The first wheel 30 is affixed to a rotatable drive shaft 33 and the second wheel 35 is affixed to a rotatable idler shaft 36, with the drive shaft 33 and idler shaft 36 being secured to the exercise machine 20, such as to its frame 23. A tensioner pulley 38 is provided as a means to create a preferred tension on the elongated member 31, with the tensioner pulley 38 being affixed to a rotatable tensioner shaft 39.

As shown in FIG. 2, a clutch 60 in the "push" position affixed to the exercise implement 26 is selectively engageable with the elongated member 31 such that when an exerciser 12 applies an exercise force FE1 in the direction shown, the exercise implement 26 moves along the length of the exercise machine 20, and the elongated member 31 correspondingly moves in the same direction, for the same length of travel as the exercise implement 26.

A first gear reduction pulley 40 is affixed to the same drive shaft 33 as the first wheel 30, with the first gear reduction pulley 40 and the first wheel 30 being concentric. The first gear reduction pulley 40 is adapted such that the first gear reduction pulley 40 rotates in response to exercise forces exerted upon the elongated member 31. Rotation of the first gear reduction pulley 40 rotates a second gear reduction pulley 42 which is separately connected to a gear reduction shaft 44; with the first gear reduction pulley 40 and the second gear reduction pulley 42 being interconnected by a gear reduction drive belt 43, thereby reducing the angle of rotation of the a resistance pulley 56 connected to the same gear reduction shaft 44 relative to the first gear reduction pulley 40.

As shown in the figures, the resistance pulley 56 is connected to the gear reduction shaft 44 such that the resistance pulley 56 and the second gear reduction pulley 42 are concentric. The resistance pulley 56 is preferably of a smaller diameter than the first wheel 30 and a larger diameter than the first gear reduction pulley 40 as shown in the figures. The bias member 52 is interconnected with the resistance pulley 56 such that resistance force is applied against rotation of the resistance pulley 56 in a first direction. The bias member 52 may be directly connected to the resistance pulley 56, or may be connected to the resistance pulley 56 by a bias connector 50 such as a cable as shown in the figures.

It is preferable that the first end 53 of the bias members 52, where affixed to a bias connector 50, travel a distance shorter than the measurable travel of the exercise implement 26. The second end 54 of the bias members 52 is attached to the frame 23. More specifically, the use of the gear reduction pulleys 40, 42 just described limits the rotation of the resistance pulley 56 to one revolution relative to the total range of travel of the exercise implement 26, thereby limiting the bias connector 50 or bias member 52 winding about the resistance pulley 56 to one wrap. It is well known to those skilled in the art that when a cable is wrapped multiple times around itself on a pulley, the effective diameter of the pulley increases, and the force necessary to rotate the pulley increases. In the exercise machine of the present invention, a constant and predictable linear force against a predetermined resistance force FR is preferred to the requirement of an increasing force to continue rotating the resistance pulley 56.

As the second gear reduction pulley 42 is rotated in response to the input exercise force upon the exercise implement 26, the resistance pulley 56 similarly rotates with the same gear reduction shaft 44 such that the bias connector 50 free length shortens, thereby overcoming a predetermined resistance force FR extending one or more of the bias members 52 provided as a means to resist the exercise input force FEL Oftentimes, it is preferable that an exerciser 12 contracts muscles that pull loads or resistance, rather than contracting opposing muscles that push loads or resistances. In such situations, an exerciser would shift the clutch from a "push" position as shown in FIGS. 2 and 4 to a "pull" position shown in FIGS. 3 and 5, thereby engaging teeth 32 on the elongated member 31 on the opposite side of the first wheel 30. As can readily be seen in the pull-force exercise configuration shown in the figures, with the clutch 60 engaged in the pull position and disengaged in the push position, the exerciser 12 may immediately begin exerting an exercise force on the exercise implement 26 in the opposite direction FE2, thereby providing for the engagement and exercise of the pulling muscles by directing the force against a resistance force FR.

Those expert in exercise machines 20, and more specifically Pilates apparatuses, will immediately appreciate the benefit of providing the previously unknown system and method of reversing the direction of force that an exercise exerts upon an exercise implement 26, including the ability to change from a pulling exercise to pushing exercise with little or no interruption of the overall exercise routine, and the elimination of the traditional requirement for an exerciser 12 to completely rotate their position upon an exercise machine 20 so that they are facing in a second direction opposite of the first direction so that they can engage a different set of muscles. Further, they will appreciate that by providing for the reversal of force direction upon the exercise implement 26, the pushing and pulling exercises may be applied to a set of handles 25 at a first end 21 of the exercise machine 20, thereby eliminating the requirement for any handles 25 at the second end 22 of the exercise machine 20.

The figures illustrate the elongated member 31 as comprising a belt having a plurality of teeth 32 on its inner circumference. One of ordinary skill in the art will appreciate that multiple other types of drive connectors 31 may be utilized with the present invention, such as chains and the like. It should be noted that the preferable use of teeth 32 on the elongated member 31 is not meant to be limiting, flat belts, V-belts, as well as chains delivering the functionality just described may be used without deviating from the novel functionality of the present invention.

Further, the preferred clutch 60 system just described provides for the engagement of gear features of the clutch 60, such as either of the ends 65, 66 of the engaging portion 64 shown in the figures, with teeth 32 on the elongated member 31 is not meant to be limiting, and the alternative methods of engaging a clutch 60 with an elongated member 31 such as a belt may include friction clamps such as a V-grooved plate engageable with a V-belt. Therefore, many methods of engaging the inside surface of a drive connector are well known, and may be used to accomplish the intended result in the novel, and previously unavailable system and method of the present invention providing for reversibly directing an exerciser's exercise force against one or more springs that provide resistance force FR in only one direction FE1 or FE2.

In use, the clutch 60 will generally start in a position in which it is not engaged with any portion of the elongated member 31. In this position, the exercise implement 26 may freely traverse the exercise machine 20 without any resistance from the bias member 52. The exerciser 12 may freely position the exercise implement 26 at the desired location to begin an exercise without any force of resistance being transferred from the bias member 52 while the clutch 60 is disengaged.

Once the exercise implement 26 is located at the desired starting position for exercises, the clutch 60 may be engaged such that the bias member 52 exerts resistance against the exercise implement 26 as it is moved in a first direction FE1. In this case, the clutch 60 may be pulled upwardly such that the first end 65 of the engagement portion 64 of the clutch 60 engages with the first run 31*a* of the elongated member 31 as shown in FIG. 2. One manner of such engagement is shown in the figures, in which the first end 65 of the engagement portion 64 engages with the teeth 32 on the first run 31*a* of the first wheel 30. The exerciser 12 may then perform various exercises with the exercise implement 26 being biased against movement in the first direction FEL Upon completion a first set of exercises, the exerciser 12 may desire to reverse the direction of resistance. Utilizing the present invention, the exerciser 12 may easily and efficiently reverse the direction of resistance against the exercise implement 26 using only the clutch. Without getting off the carriage 12 or manipulating any other structure, the exerciser 12 may simply force the clutch 60 downwardly such that the first end 65 of the engagement portion 64 disengages with the first run 31*a* of the elongated member 31. With continued downward force, the second end 66 of the engagement portion 64 will engage with the second run 31*b* of the elongated member 31. When so configured, the exercise implement 26 will be resisted against movement in the second direction FE2. The exerciser 12 may then continue with a different set of exercises which utilizes the opposite direction of resistance than the first set of exercises.

The exerciser 12 may repeat these steps repeatedly to perform different sets of exercises against different directions of resistance. The exerciser 12 may dismount the present invention at any time. It may be preferable to position the clutch 60 in its disengaged position (i.e. the engagement portion 64 does not engage with any portion of the elongated member 31) such that the exercise implement 26 is freely movable into any position by a future exerciser 12.

FIGS. 4 and 5 are exemplary diagrams showing a side view of the present invention in a vertical orientation. More specifically, the embodiment of the exercise machine reversible resistance system 10 shown in FIGS. 1-3 is shown rotated so that the longitudinal axis to which a linear exercise force is applied to an exercise implement 26 is tilted so that the exercise force axis is substantially vertical. Utilizing the same principles as previously described, the present invention provides for a plurality of exercises typically performed while the upper body is substantially vertical.

For instance, those skilled in the art will appreciate that exercise machines 20 referred to as bicep curl machines allow an exerciser 12 to approach the machine, with arms substantially straight and extended grasp a handle 25 serving as an exercise implement 26 with one or both hands, and contract the bicep muscle against a resistance force until the hand is proximal to its respective shoulder. Thereafter, the exerciser would reverse the action, slowly releasing the bicep contraction, thereby allowing the lower arm to extend back to substantially the starting position.

One advantage of the present invention is that the exercise machine 20 as previously described weighs less than a machine that uses stacked weights. For example, a plurality of bias members 52, together with an indexable resistance level selector with 15 ten pound increments, would provide a maximum of 150 lbs or resistance force for exercising biceps. The gross weight of the apparatus that includes the transmission system and bias members 52 would be estimated to weigh 80 pounds, depending on materials construction.

On the other hand, traditional curl machines using similar materials as just described, and that provide 150 pounds maximum resistance force, would necessarily contain a stack of 15 ten pound iron or steel weights, thereby weighing at least 150 pounds. Therefore, the weight savings which correspond to reduced manufacturing and freight costs, and reduced labor costs for delivering and setting up a curl machine in a gym are all reduced; making the variable transmission system commercially advantageous.

Further, by integrating the reversing clutch 60 system as herein described, the curl machine embodiment of the present invention shown in FIGS. 4-5 can be immediately reversed, thereby becoming a triceps machine wherein an exerciser 12 starts with bent arms, and after grasping the handle 25 which serve as exercise implements 26, may then extend their arms while pushing the handles 25 with a downward force by flexing their triceps. It is well known that exercisers 12 are advised to exercise counteracting muscles during a workout. Therefore, triceps and biceps are counteracting muscles, and after completing exercises for one muscle group, the opposing muscle group should be exercised.

Traditional gym machines do not provide for the reversing of the direction of exercise force since they are single exercise/single purpose designed. The novel function of the present invention provides for one exercise machine 20 that may functionally replace at least two traditional exercise apparatuses. Therefore, the present invention is more commercially valuable when compared to traditional gym machines in that it provides for significant reduction in the acquisition of equipment needed for a full service gym, and since in many instances, one exercise machine 20 of the present invention can replace the functionality of two machines, allowing a gym to provide the same exercise capacity, but with a substantially reduced facility size.

Although specific embodiments have been illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a frame;

a first end platform connected to the frame;

an exercise implement movably connected to the frame;

an elongated member movably positioned upon the frame, wherein the elongated member has a first run and a second run, wherein when the first run moves in a first direction the second run moves in a second direction that is substantially opposite of the first direction, and wherein when the first run moves in the second direction the second run moves in the first direction;

a resistance device connected to the elongated member, wherein the resistance device applies a resistance force to the elongated member in the second direction relative to the first run, and wherein the resistance device applies the resistance force to the elongated member in the first direction relative to the second run;

a clutch connected to the exercise implement, wherein the clutch includes an engagement portion, wherein the engagement portion is adapted to selectively engage the first run and the second run of the elongated member, such that the resistance device is configured to provide the resistance force to the exercise implement in the second direction when the clutch is engaged to the first run, and the resistance device is configured to provide the resistance force to the exercise implement in the first direction when the clutch is engaged to the second run; and wherein the resistance device is comprised of a spring or an elastic member.

2. The exercise machine of claim 1, wherein the elongated member is comprised of an endless loop structure.

3. The exercise machine of claim 2, including a first wheel rotatably connected to the frame and a second wheel rotatably connected to the frame, wherein the elongated member is movably positioned upon the first wheel and the second wheel, wherein the first run and the second run are positioned between the first wheel and the second wheel.

4. The exercise machine of claim 3, wherein the resistance device is connected to the first wheel to apply the resistance force against rotation of the first wheel in a first rotational direction.

5. The exercise machine of claim 1, wherein the elongated member includes a plurality of teeth selectively engageable by the clutch.

6. The exercise machine of claim 5, wherein the plurality of teeth extend inwardly.

7. The exercise machine of claim 1, wherein the first run and the second run are substantially parallel with respect to one another.

8. The exercise machine of claim 1, wherein the first run and the second run are each horizontally aligned.

9. The exercise machine of claim 1, wherein the first run and the second run are each vertically aligned.

10. The exercise machine of claim 1, wherein the elongated member is comprised of a belt.

11. The exercise machine of claim 1, wherein the elongated member is comprised of a chain.

12. The exercise machine of claim 1, wherein the clutch is comprised of a linear clutch.

13. The exercise machine of claim 1, wherein the clutch includes an actuator connected to the engagement portion and adapted to linearly translate the engagement portion to a retracted position and an extended position, wherein the engagement portion includes a first end and a second end opposite of the first end, wherein the first end of the engagement portion is adapted to selectively engage the first run in the retracted position, and the second end of the engagement portion is adapted to selectively engage the second run in the extended position.

14. The exercise machine of claim 1, wherein the frame includes a first rail and a second rail, wherein the second rail is parallel with respect to the first rail, and wherein the exercise implement is movably positioned upon the first rail and the second rail.

15. The exercise machine of claim 1, wherein the exercise implement is comprised of a carriage.

16. The exercise machine of claim 1, wherein the exercise implement is comprised of a handle.

17. An exercise machine, comprising:

a frame;

a first end platform connected to the frame;

an exercise implement movably connected to the frame;

an elongated member movably positioned upon the frame, wherein the elongated member has a first run and a second run, wherein when the first run moves in a first direction the second run moves in a second direction that is substantially opposite of the first direction, and wherein when the first run moves in the second direction the second run moves in the first direction;

a resistance device connected to the elongated member, wherein the resistance device applies a resistance force to the elongated member and the exercise implement in the second direction relative to the first run, and wherein the resistance device applies the resistance force to the elongated member and the exercise implement in the first direction relative to the second run;

a clutch connected to the exercise implement, wherein the clutch includes an engagement portion, wherein the engagement portion is adapted to selectively engage the first run and the second run of the elongated member, such that the resistance device is configured to provide the resistance force to the exercise implement in the second direction when the clutch is engaged to the first run, and the resistance device is configured to provide the resistance force to the exercise implement in the first direction when the clutch is engaged to the second run;

wherein the clutch includes an actuator connected to the engagement portion and adapted to linearly translate the engagement portion to a retracted position and an extended position, wherein the engagement portion includes a first end and a second end opposite of the first end, wherein the first end of the engagement portion is adapted to selectively engage the first run in the retracted position, and the second end of the engagement portion is adapted to selectively engage the second run in the extended position; and wherein the resistance device is comprised of a spring or an elastic member.

18. An exercise machine, comprising:

a frame;

an exercise implement movably connected to the frame;

wherein the frame includes a first rail and a second rail, wherein the second rail is parallel with respect to the first rail, and wherein the exercise implement is movably positioned upon the first rail and the second rail;

an elongated member movably positioned upon the frame, wherein the elongated member has a first run and a second run, wherein when the first run moves in a first direction the second run moves in a second direction that is substantially opposite of the first direction, and wherein when the first run moves in the second direction the second run moves in the first direction;

a resistance device connected to the elongated member, wherein the resistance device applies a resistance force to the elongated member in the second direction relative to the first run, and wherein the resistance device applies the resistance force to the elongated member in the first direction relative to the second run;

a clutch connected to the exercise implement, wherein the clutch includes an engagement portion, wherein the engagement portion is adapted to selectively engage the first run and the second run of the elongated member, such that the resistance device is configured to provide the resistance force to the exercise implement in the second direction when the clutch is engaged to the first run, and the resistance device is configured to provide the resistance force to the exercise implement in the first direction when the clutch is engaged to the second run; and wherein the resistance device is comprised of a spring or an elastic member.

* * * * *